US006111337A

United States Patent [19]

Christensen

[11] Patent Number: 6,111,337

[45] Date of Patent: Aug. 29, 2000

[54] ULTRASONIC TRANSDUCER DIPOLE

[76] Inventor: Juan Carlos Christensen, Discepolo 909, Dto. "F2B", (1642) San Isidro, Buenos Aires, Argentina

[21] Appl. No.: 09/357,548

[22] Filed: Jul. 20, 1999

[51] Int. Cl.[7] ..... B06B 3/00

[52] U.S. Cl. ..... 310/328

[58] Field of Search ..... 310/328

[56] References Cited

U.S. PATENT DOCUMENTS

| | | | |
|---|---|---|---|
| 4,594,584 | 6/1986 | Pfeiffer et al. | 340/620 |
| 4,615,591 | 10/1986 | Smith et al. | 350/507 |
| 4,709,210 | 11/1987 | Pond | 324/207 |
| 5,200,666 | 4/1993 | Walter et al. | 310/323 |
| 5,459,699 | 10/1995 | Walter | 367/142 |
| 5,821,743 | 10/1998 | Page et al. | 324/207.13 |

*Primary Examiner*—Thomas M. Dougherty
*Attorney, Agent, or Firm*—Baker Botts L.L.P.

[57] ABSTRACT

Ultrasonic transducer dipole of the type comprising an electromechanical transducer motor assembly and two pads, characterized in that it consists of at least one dipole, formed by two metal pipes which present one reentrant symmetrical matching pad each at their ends and two central symmetrical metal pads in the middle, containing at least one prestressed piezoelectric crystal and the connecting elements to the source of excitation of at least one of said piezoelectric crystals, and coupled with the free ends of said pipes.

6 Claims, 2 Drawing Sheets

ULTRASONIC TRANSDUCER DIPOLE

BACKGROUND OF INVENTION

The invention concerns an ultrasonic transducer dipole, in which an electromechanical transducer motor assembly and two symmetrical pads resonate and excite a resonant assembly of two pipes, coupled to two reentrant matching pads at their ends, especially suitable for performing ultrasonic cleaning tasks.

Among the cleaning applications of the invention, one can mention the ultrasonic cleaning of pieces submerged in a liquid medium, without the need to use a stainless steel vat; ultrasonic cleaning of the inside of receptacles holding a liquid, such as tanks, basins and containers.

It can also be used in acoustic applications, where it is desired to transmit the ultrasound to a gaseous medium.

In ultrasonic transducers, the best coupling to the load is sought with the highest possible yield and lowest cost of production, installation and maintenance.

The most common ultrasonic transducers for applications in liquid media are those which in general are coupled glued to the walls of the stainless vat containing them, and the electromechanical transducer commonly used consists of one or more piezoelectric disks compressed between two pads of materials and sizes suitable for optimizing it.

For low power and service applications, the ceramic crystal is directly glued to the receptacle, that is, without the use of pads and matching pads.

Due to the fact that these ultrasonic transducers are glued, are coupled to a small area of the receptacles and therefore dissipate a good part of the energy in the air, not a great deal of power can be handled in them.

On the other hand, on making the receptacle to which they are adhere vibrate, their yield is not high and they generate troublesome noises.

Another type of ultrasonic transducer is submersible, consisting of stainless steel sealed boxes, with the transducers glued inside, which, not being in contact with the vat, generate less noise and have fewer losses, but present the disadvantage of being bulky, expensive and requiring many transducers to work at high powers.

Another variant of known submersible transducers is that of tubular type, making a pipe vibrate in the liquid.

One type of such tubular transducer compresses and expands a pipe on exciting it by means of an electromechanical transducer placed at one end and a matching pad at the other.

During its operation, it is sought to tune it so that the end presenting the transducer does not vibrate, since that energy is not used in washing, but this is not satisfactorily accomplished and one does not obtain a very low impedance in phase with resonance.

The matching pad of the motor vibrates in an air cavity, the latter not being taken advantage of, and the dissipation of heat occurs basically through the pad in contact with the pipe, so that the heat is not well extracted.

The pad at the end of the pipe does not produce the same level of cavitation as the pipe through which useful volume and radiant area are lost.

The motor being contained within a pipe of greater diameter and weakly coupled, of "sonotrodo" type, radiation is not produced in that space, so that its capacity is not taken advantage of fully.

When a vat is constructed, it is sought to take maximum advantage of the volume of liquid and, for that purpose, it is necessary for the pieces to be washed to be put face to face as much as possible with radiant surfaces, for which reason efficiency and greater power handling capacity are lost with this type of tubular transducer.

Another known type is the so-called push-pull, in which the pipe is compressed and expanded between two motors of "sonotrodo" type like the previous one, which is disclosed in U.S. Pat. No. 5,200,666 of Walter et al.

This configuration radiates minimum energy longitudinally, but necessitates double the transducers and the problem persists of matching pads not taken advantage of, dissipation of heat on only one face of the transducer and the problem persists of matching pads not taken advantage of, dissipation of heat on only one face of the transducer and the fact that the transducers occupy considerable space at the ends.

SUMMARY OF THE INVENTION

In order to make up for all the disadvantages mentioned, in the present invention, instead of only one pipe, two pipes are used, which are compressed and expanded between a center electromechanical transducer, with one pad each at its ends.

Being of a symmetrical topology, both faces of the transducer are coupled and dissipate energy in the liquid, so that double the power of a single transducer can be obtained.

The pads at the free ends of the pipes, instead of projecting, as in known transducers, are mounted inward, so that their maximum vibration is brought inside the pipes and not in the liquid, and there is thus minimum vibration at the ends of the pipes.

This "reentrant" type mounting of the pads causes all the energy to radiate transversely and not longitudinally and greater radiation to be produced toward the ends.

The fact that there is minimum vibration at the ends enables the transducer to be mounted either by means of a T-shaped piece in its center or fastening it at the ends.

Mounting by means of a center "T" is of interest for those applications in which the vat is plastic, since, being the center of gravity of the dipole and a node of minimum vibration, the latter does not exert moments not vibrations on the plastic wall of the vat.

This results in a very compact transducer of very high yield, in which the electromechanical transducer can be given double the power of previous applications for the same type of piezoelectric crystal, and it can also be mounted in a wall-to-wall vat radiating energy along its entire course.

An additional advantage of this transducer, an object of the invention, is that in case it should be necessary to radiate ultrasound over very long distances and on high power, this symmetrical configuration can be repeated with a sequence of dipoles that have only two reentrant matching pads at the ends, giving a "sequential type" configuration.

The object of this invention is then an ultrasonic transducer dipole of the type comprising an electromechanical transducer motor assembly and two pads, consisting of at least one dipole, formed by two metal pipes, which present one reentrant symmetrical matching pad each at their ends, and two central symmetrical matching pad each at their ends, and two central symmetrical metal pads in the middle, contain at least one prestressed piezoelectric crystal and the connecting elements to the source of excitation of at least one of said piezoelectric crystals, and are coupled with the free ends of said pipes.

The ultrasonic transducer pole consists basically of two modules:

An electromechanical transducer module, in which the electric energy is converted into mechanical energy, and a pipe module.

In a preferred version that includes piezoelectric crystals, one or more crystals prestressed by a center rod are used, coupled to two symmetrical center pads that perform the function of resonating with the crystals and of being coupled to the pipes.

The number of crystals and their diameter depend on the frequency and the power it is intended to handle.

This assembly is made tight in the center with a piece forming a "T" with the dipole, which acts as a support of sealing for the liquid and mounting of the dipole, since the elements connecting the crystals to the source of excitation pass through it.

In the case of mounting of the transducer at one end or at both and in the case of a "sequential type" configuration, in which several dipoles, ending in reentrant pads only at the ends, are joined to produce a long transducer pipe, the piece forming a "T" with the dipole is replaced by one or more coupling pipes which, instead of sealing the space of the crystals, is tapped with a left-hand and right-hand thread, and it is used to pre-stress the crystals without generating spurious tensions and to facilitate assembly, since the rest of the "sequential type" dipole is thus prevented from turning on applying the necessary torque to the coupling pipes.

This configuration makes it possible in "kit" type modular form to obtain transducers of greater length.

In the case of T-shaped mounting, the connecting cables come out of the center branch of same and, in the case of coupling pipes, the crystals are connected coaxially with a cable that goes inside the pipes.

The transducer dipole also consists of a pipe module made up of two pipes welded to the electromechanical transducer module in the center and presenting one reentrant matching pad each at the ends.

These matching pads, in the case of mounting of the transducer at its ends, present a center hole for passage of the feed cable and it is supported by a projection for sealing with "O ring" and three openings for screwing to the wall of the vat.

In the case of the "sequential type" configuration, only the pipes at the two ends are finished off with reentrant pads and the pipes placed between electromechanical transducers are pipes double the length of the pipes at the ends.

In this case, the piezoelectric crystals having a center hole, the live end of the center electrodes is connected by a cable passing through the center and the pad is connected using the metal pipe.

Further objects, features and advantages of the invention will become apparent from the following detailed description taken in conjunction with the accompanying figures showing illustrative embodiments of the invention.

DETAILED DESCRIPTION OF THE PREFERRED EMBODIMENTS

Figure 1:
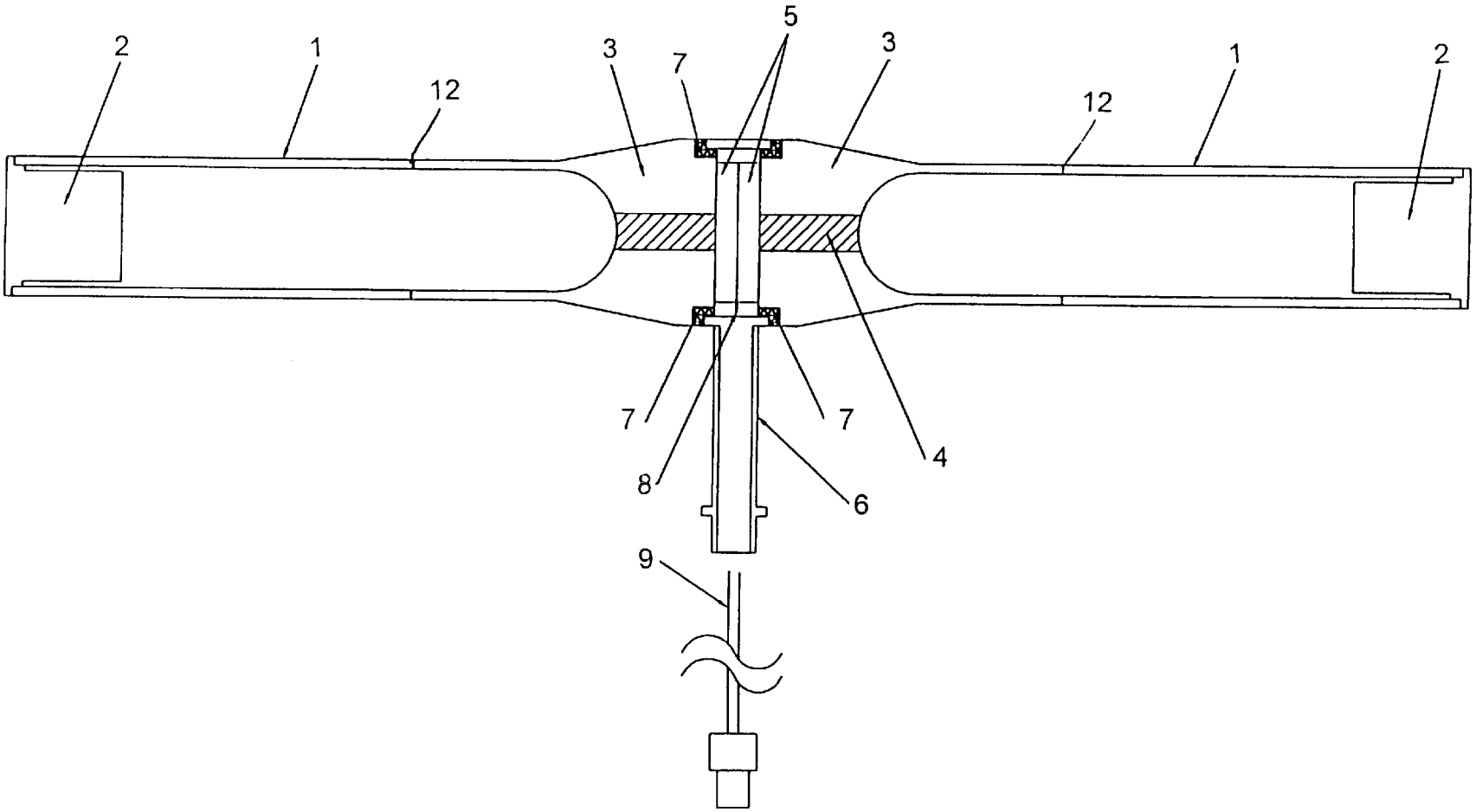
In FIG. 1, an ultrasonic transducer dipole is represented.

Represented in FIG. 1 are the metal pipes 1 and the reentrant matching pads 2 at the ends of same;

The central symmetrical metal pads 3, which are continued in one and the same piece until reaching a minimum point of vibration 12, in order to be joined to said pipes 1 by welding;

The prestressed piezoelectric crystals 5 with a rod 4, arranged inside said center pads 3;

The piece 6 that closes and supports the dipole with the "O rings" 7 and that forms a "T" with same.

The dipole is connected with a coaxial cable 9 and by means of conducting plates 8 to the piezoelectric crystals 5.

Figure 2:
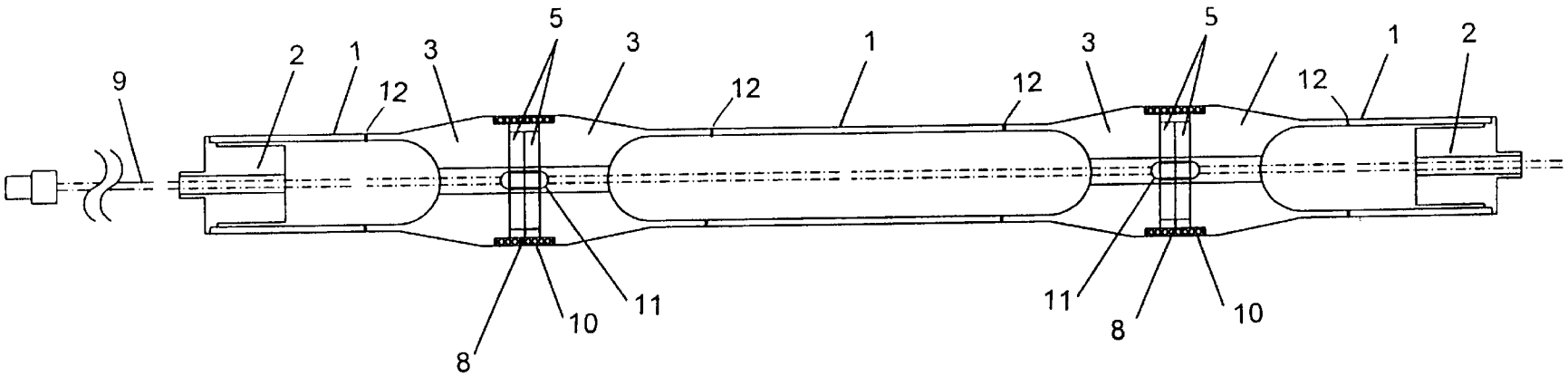
In FIG. 2, a sequential type ultrasonic transducer is represented, formed by two ultrasonic dipoles; and In FIG. 3, a front view of a matching pad is shown, with connecting holes to the wall of a vat.
Figure 3:
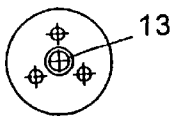

Represented in FIG. 2 is a "sequential type" configuration, which can be of n modules of "kit" type and in this case is of two modules;

In this case, the central symmetrical pads 3, which are continued until reaching a minimum point of vibration 12 for welding and include the piezoelectric crystals 5 prestressed by means of threaded caps 10.

The coaxial connecting cable 9, which is continued inside, and the conducting plates 8 for connection of the piezoelectric crystals 5 and the connectors 11 linking them come out through a center hole 13 machined in one of the matching pads 2.

The transducer dipole, an object of the invention, can be mounted in different ways, depending on the need and application.

In case of using a center "T," it can be mounted on the sides or bottom of the vat.

In case of mounting it from its ends, as in the case of the "sequential type" configuration, it can be used in vertical or horizontal form, and its size and working frequency are adjusted according to the application.

A preferred embodiment is set forth below:

A two-inch diameter stainless steel prototype was constructed to operate at a frequency of 26 kHz.

Two ceramic piezoelectric crystals were used, 38 mm in diameter, 6 mm thick and with center hole of 12.8 mm, made of p-841 material of the firm of Stettner.

A 12-mm stainless steel rod and alpaca contacts were used.

Special "O rings" were made for the tests and teflon was used as insulator of the center electrode.

Stainless steel popes 31 mm in diameter were also used and the matching pads were made of stainless steel.

The assembly was tuned to the working frequency.

The assembly was tested with a generator designed for this purpose, controlled by microprocessor, and it was verified in a 500-liter vat that it does not radiate at the ends, that cavitation is uniform throughout the vat and the dipole temperature is that of the liquid, whereby it is deduced that it is well-coupled.

Tests were conducted up to a power of 2 KW and it was verified that impedance is constant and resistive and very low and that the Q is elevated.

Titanium can be used in the more demanding applications.

I claim:

1. An ultrasonic transducer dipole having an electromechanical transducer motor assembly and two pads, comprising at least one dipole, formed by two metal pipes which present one reentrant symmetrical matching pad each at their ends and two central symmetrical metal pads in the middle, containing at least one prestressed piezoelectric crystal and the connecting elements to the source of excitation of at least one of said piezoelectric crystals, and coupled with the free ends of said pipes.

2. The transducer dipole of claim 1, wherein the central metals pads are extended to a point of minimum vibration coupling with the free ends of said pipes.

3. The transducer dipole of claim 1, wherein said central symmetrical metal pads are coupled with the free ends of said pipes by welding.

4. The transducer device of claim 1, wherein at least one of said crystals is prestressed by means of at least one rod.

5. The transducer dipole of claim 1, wherein said connecting elements pass through a piece forming a "T" with said transducer dipole and assembled with same.

6. The transducer dipole of claim 1, wherein said dipole comprises several dipoles.

* * * * *